US007325504B2

(12) United States Patent
Tsumiyama

(10) Patent No.: US 7,325,504 B2
(45) Date of Patent: Feb. 5, 2008

(54) DISPLAY DEVICE OF PERSONAL WATERCRAFT

(75) Inventor: Yoshinori Tsumiyama, Miki (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 167 days.

(21) Appl. No.: 11/202,645

(22) Filed: Aug. 11, 2005

(65) Prior Publication Data

US 2006/0040570 A1 Feb. 23, 2006

(30) Foreign Application Priority Data

Aug. 19, 2004 (JP) ..... 2004-238965

(51) Int. Cl.
*B63B 35/73* (2006.01)
*B60Q 1/00* (2006.01)

(52) U.S. Cl. ..... 114/55.5; 340/441

(58) Field of Classification Search ..... 114/55.5; 701/21

See application file for complete search history.

(56) References Cited

U.S. PATENT DOCUMENTS 6,774,773 B2 * 8/2004 Funayose et al. ..... 340/441

FOREIGN PATENT DOCUMENTS

JP 2003-89392 3/2003

* cited by examiner

*Primary Examiner*—Jesus D. Sotelo
(74) *Attorney, Agent, or Firm*—Alleman Hall McCoy Russell & Tuttle LLP

(57) ABSTRACT

A display device of a personal watercraft is disclosed. The display device typically includes a memory configured to store a plurality of control modes for controlling components of the watercraft, a controller configured to control the components of the watercraft based on a control mode selected from the control modes, and a display portion that is provided in a display panel positioned in the vicinity of a steering handle of the watercraft and is configured to display operating information of the watercraft based on a signal from the controller while the watercraft is traveling. The display portion is configured to display mode information indicating the watercraft is controlled based on the selected control mode instead of the operating information when the controller controls the watercraft based on the selected control mode.

5 Claims, 10 Drawing Sheets

DISPLAY DEVICE OF PERSONAL WATERCRAFT

BACKGROUND OF THE INVENTION

1. Field of the Invention

The present invention generally relates to a display device equipped in personal watercraft. More particularly, the present invention relates to a display device that is equipped in a personal watercraft including a controller configured to control components based on a control mode selected from a plurality of control modes and that is configured to display the selected control mode.

2. Description of the Related Art

When several riders share one personal watercraft, each rider may have different cruising performance preferences and hence may desire to vary an engine output characteristic depending on their preferences.

To meet such a demand, there has been disclosed a personal watercraft that is capable of switching between a normal operation in which an engine output is not limited and a limited operation in which the engine output is limited (see Japanese Laid-Open Patent Application Publication No. 2003-89392). Furthermore, the personal watercraft is configured to light up or blink an indicator light equipped in a display panel to enable a rider to be informed of the limited operation while traveling with the limited engine output.

The display panel of the personal watercraft is typically provided with a fuel meter or gauge; a speedometer or gauge; a display portion configured to display information such as a current time, a travel time period, a travel distance, etc.; and a variety of alarm lights. The indicator light disclosed in the Patent Application Publication No. 2003-89392 is separate from the display portion or the alarm lights. However, since the display panel of the personal watercraft is provided in a limited space, for example, in the vicinity of a steering handle and in a position to enable the rider to easily check the information while traveling, it is difficult to provide space for placing the indicator light separately from the display portion and the alarm lights.

SUMMARY OF THE INVENTION

The present invention addresses the above described conditions, and an object of the present invention is to provide a display device that is equipped in a personal watercraft configured to control components based on a control mode selected from a plurality of control modes, and is capable of presenting information regarding the control mode to a rider without providing an indicator light for exclusive use.

According to the present invention, there is provided a display device of a personal watercraft comprising a memory configured to store a plurality of control modes for controlling components of the watercraft; a controller configured to control the components of the watercraft based on a control mode selected from the plurality of control modes; and a display portion that is provided in a display panel positioned in the vicinity of a steering handle of the watercraft, and is configured to display operating information of the watercraft based on a signal received from the controller while the watercraft is traveling, wherein the display portion is configured to display mode information indicating the watercraft is controlled based on the selected control mode instead of the operating information when the controller controls the watercraft based on the selected control mode.

When the control mode has been switched, the mode information is displayed on the display portion instead of the operating information. Therefore, the switched mode information is presented to the rider without providing an indicator light exclusively for displaying the mode information . . . In addition, since the display portion is provided in a display panel equipped in the vicinity of a steering handle, the rider can easily check the mode information.

The display portion may be configured to alternately display the operating information and the mode information, each for a predetermined time period when the controller controls the components of the watercraft based on the selected control mode. This enables the rider to be informed of the operating information and the control mode while the watercraft is traveling in the predetermined control mode. Furthermore, since the operating information and the mode information are alternately displayed, the rider easily notices that the mode information is being displayed.

A time period during which the mode information is displayed before switching to the operating information may be set shorter than a time period during which the operating information is displayed before switching to the mode information. Thereby, the rider can recognize the mode information, and can effectively check the operating information that is displayed for a longer time period.

The plurality of control modes may include a normal output control mode in which the controller controls an engine operation without setting an upper limit of an engine output, and a low output control mode in which the controller controls the engine operation under a condition in which the upper limit of the engine output is set. The display portion may display the mode information associated with the low output control mode instead of the operating information when the controller controls the engine operation based on the low output control mode. This enables the rider to recognize the low output mode. Thus, the rider is informed of the control mode being executed.

The display panel may include an indicator light configured to light up or blink based on the signal received from the controller, and the indicator light lights up for a predetermined time period or blinks for a predetermined time period when the controller starts control based on the selected control mode. This enables the rider to effectively recognize that the control mode has been switched. The indicator light may include a speedometer, a tachometer, etc. By turning on all of these indicator lights, the rider can easily notice that the control mode has been switched.

The above and further objects and features of the invention will more fully be apparent from the following detailed description with accompanying drawings.

DETAILED DESCRIPTION OF THE PREFERRED EMBODIMENTS

Figure 1:
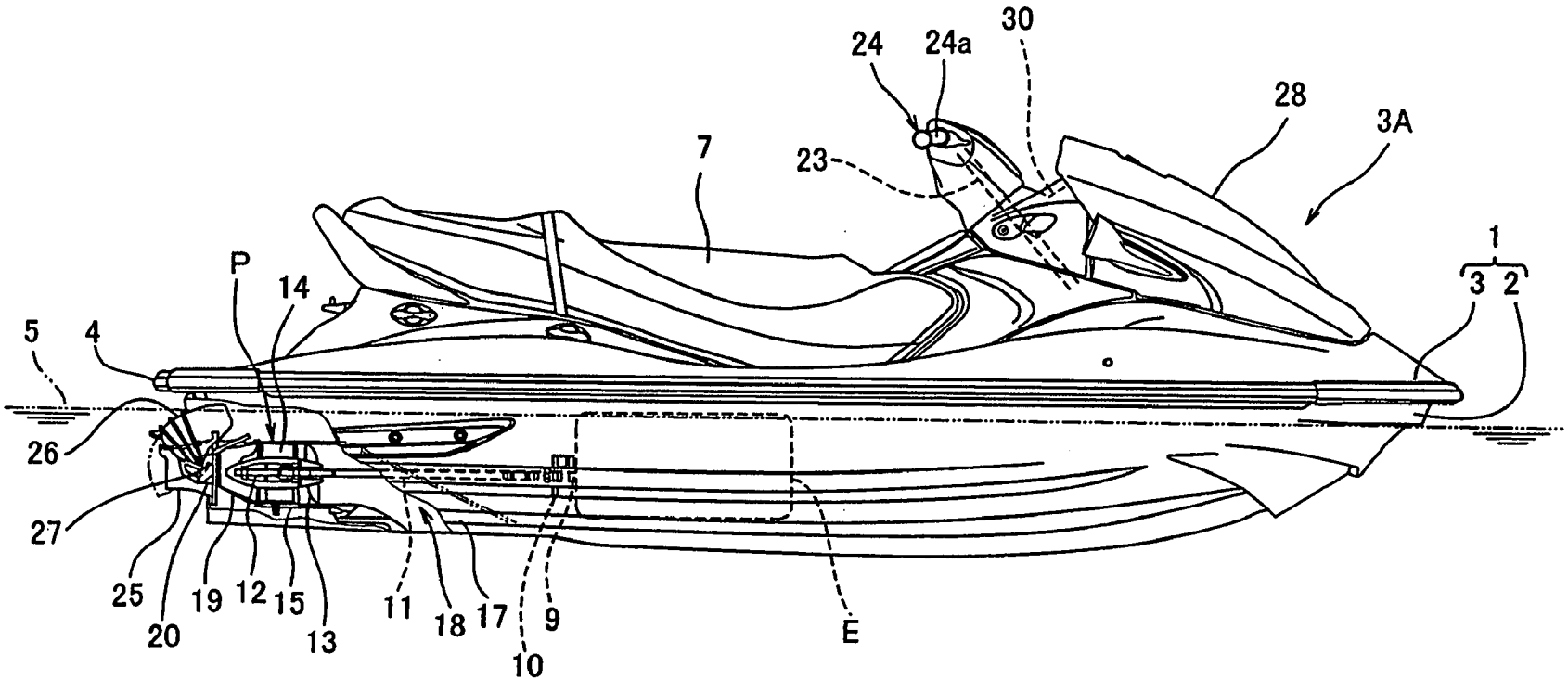
FIG. 1 is a side view of a personal watercraft according to an embodiment of the present invention, part of which is cut away to show a propulsion water jet pump.

Hereinafter, an embodiment of a display device of a personal watercraft of the present invention will be described with reference to the drawings. Turning now to FIG. 1, a straddle-type personal watercraft is shown to be equipped with a seat 7 straddled by a rider. A body 1 of the watercraft includes a hull 2 and a deck 3 covering the hull 2 from above. A line at which the hull 2 and the deck 3 are connected over the entire perimeter thereof is called a gunnel line 4. In FIG. 1, the gunnel line 4 is located above a waterline 5 of the personal watercraft.

Figure 2:
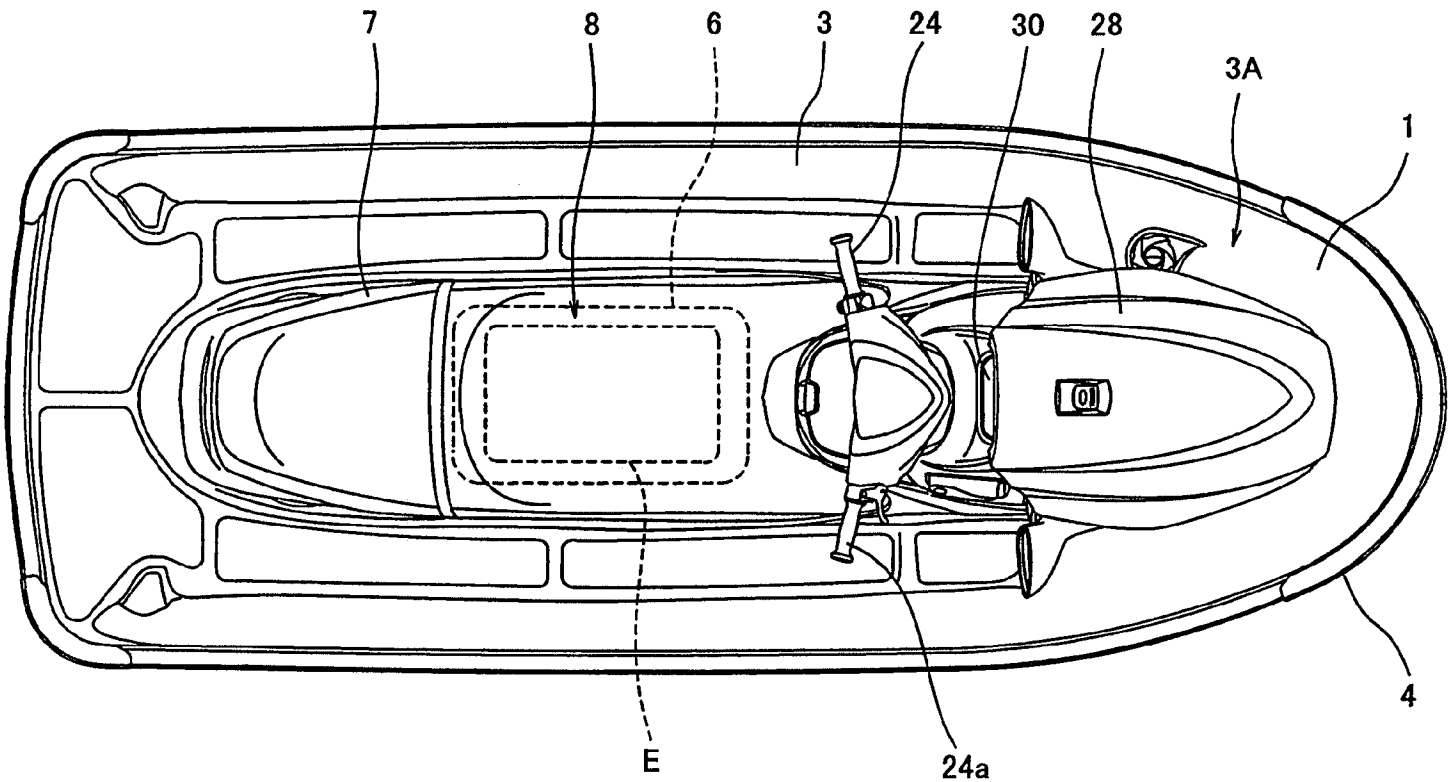
FIG. 2 is a plan view of the personal watercraft of FIG. 1.

As shown in FIG. 2, a deck opening 6, which has a substantially rectangular shape as seen from above is formed at a substantially center section of the deck 3 in the upper portion of the body 1 such that its longitudinal direction corresponds with the longitudinal direction of the body 1. The seat 7 is removably mounted over the deck opening 6. An engine room 8 is provided in a space defined by the hull 2 and the deck 3 below the deck opening 6. The engine room 8 has a convex-shaped transverse cross-section and is configured such that its upper portion is smaller than its lower portion. An engine. E is mounted within the engine room 8 and is configured to drive the watercraft. In this embodiment, the engine E is an in-line four-cylinder four-cycle engine.

As shown in FIG. 1, the engine E is mounted such that a crankshaft 9 extends along the longitudinal direction of the body 1. An output end of the crankshaft 9 is coupled to a propeller shaft 11 through a coupling device 10. The propeller shaft 11 is coupled to a pump shaft 12 of the water jet pump P mounted on the rear side of the body 1. The pump shaft 12 is configured to rotate integrally with the crankshaft 9. An impeller 13 is attached on the pump shaft 12. Fairing vanes 14 are provided behind the impeller 13. The impeller 13 is covered with a tubular pump casing 15 on the outer periphery thereof.

A water intake 17 is provided on the bottom of the body 1. The water intake 17 is connected to a front portion of the pump casing 15 through a water passage 18. A pump nozzle 19 is provided on the rear side of the body 1 and is coupled to a rear portion of the pump casing 15. The pump nozzle 19 has a cross-sectional area that is gradually reduced rearward, and an outlet port 20 is provided on the rear end of the pump nozzle 19.

In the above constructed personal watercraft, water outside the watercraft is sucked from the water intake 17 provided on the bottom of the hull 2 and is fed to the water jet pump P. The water jet pump P pressurizes and accelerates the water, and the fairing vanes 14 guide water flow behind the impeller 13. The water is ejected through the pump nozzle 19 and from the outlet port 20. As the resulting reaction, the watercraft obtains a propulsion force.

A steering shaft 23 is provided forward of the seat 7 so as to extend vertically through an inside of the deck 3 and to protrude upward from the deck 3. A bar-type steering handle 24 is mounted at an upper end portion of the steering shaft 23. A lower end portion of the steering shaft 23 is connected to a steering nozzle 25 positioned behind the steering nozzle 19 through a cable (not shown). When the rider rotates the handle 24 clockwise or counterclockwise, the steering nozzle 25 pivots toward the opposite direction so that the ejection direction of the water being ejected through the pump nozzle 19 can be changed, and the watercraft can be correspondingly turned to any desired direction while the water jet pump P is generating the propulsion force.

As shown in FIG. 1, a bowl-shaped reverse deflector 26 is provided on the rear side of the body 1 and on an upper portion of the steering nozzle 25 such that it is vertically pivotable around a pivot shaft 27 that is oriented horizontally. When the deflector 26 is pivoted downward around the pivot shaft 27 to be positioned behind the steering nozzle 25, the water ejected from the steering nozzle 25 collides against an inner surface of the deflector 26 and is thereby directed substantially forward. Thereby, the watercraft is propelled rearward.

Figure 3:
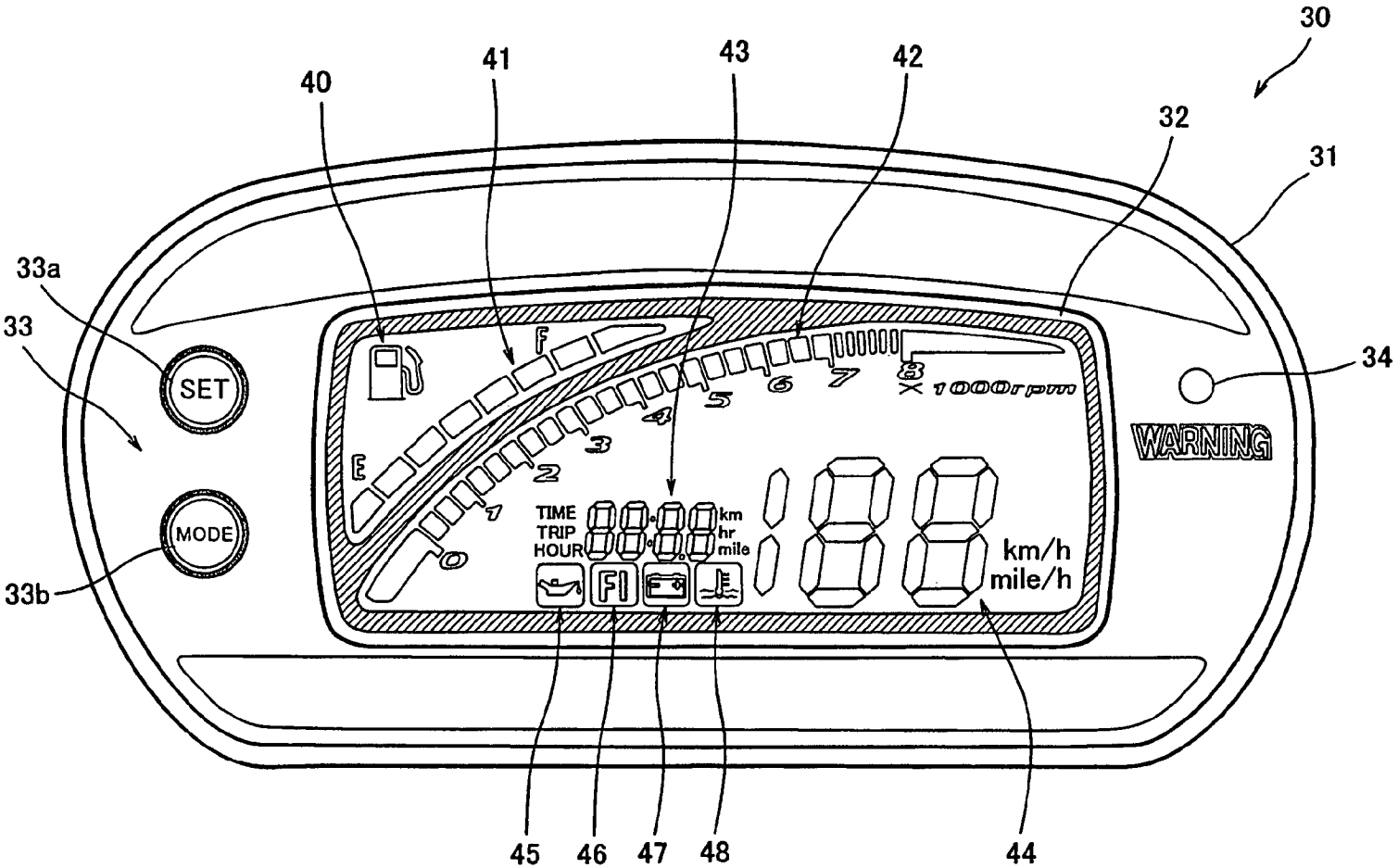
FIG. 3 is a view of an instrument panel equipped in the personal watercraft of FIG. 1.

As shown in FIGS. 1 and 2, an instrument panel 30 is provided in front of and in the vicinity of the handle 24. The instrument panel 30 is capable of displaying a variety of information such as travel speed, remaining fuel amount, etc. (see. FIG. 3). A hatch cover 28 is provided on a forward deck portion 3A of the deck 3 which is located forward of the handle 24 so as to extend from a fore region to a region immediately before the handle 24. The hatch cover 28 is pivotally mounted around a front end portion thereof in the vicinity of fore. A pivot operation of the hatch cover 28 is facilitated by a spring and damper mechanism (not shown). A rear end portion of the hatch cover 28 extends to a region above the instrument panel 30. The hatch cover 28 also serves as a visor of the instrument panel 30.

Turning to FIG. 3, the instrument panel 30 is constructed such that a display panel 32, a button switch 33, and a warning lamp 34 and fitted into a panel case 31 which is formed of synthetic resin and is of a substantially oval shape which is laterally elongated. The display panel 32 is provided with numerous liquid crystal cells.

The display panel 32 is provided in a center section of the panel case 31 and is of a substantially rectangular shape which is laterally elongated. The display panel 32 includes indicator lights 40 through 48 configured to light up or blink to indicate various statuses of the personal watercraft. Specifically, the display panel 32 includes a fuel meter mark 40 and a fuel meter or gauge 41 in a left front region thereof; a tachometer 42 configured to indicate an engine speed of the engine E in a region extending from a left rear position to a right front position in the display panel 32; a multi-display portion 43 configured to display, in a rear center region thereof, operating information regarding an operating state of the personal watercraft, such as current time, travel time period, travel distance, etc.; a speedometer 44 configured to indicate a travel speed on the right side of the multi-display portion 43; and an oil-pressure warning mark 45, a FI warning mark 46, a battery warning mark 47, and a cooling water temperature warning mark 48, which are provided behind the multi-display portion 43, etc.

The button switch 33 is positioned on the left side of the display panel 32 and includes a set switch 33*a* that is located on a front side and is configured to reset the current time or the travel time period, and a mode switch 33*b* that is located on a rear side and is configured to enable the rider to select (shift) a control mode of the watercraft as will be described later. The warning lamp 34 includes a LED that is located on the right side of the display panel 32 to be embedded in the panel case 31 and is configured to light up or blink when some abnormality occurs in the personal watercraft.

Figure 4:
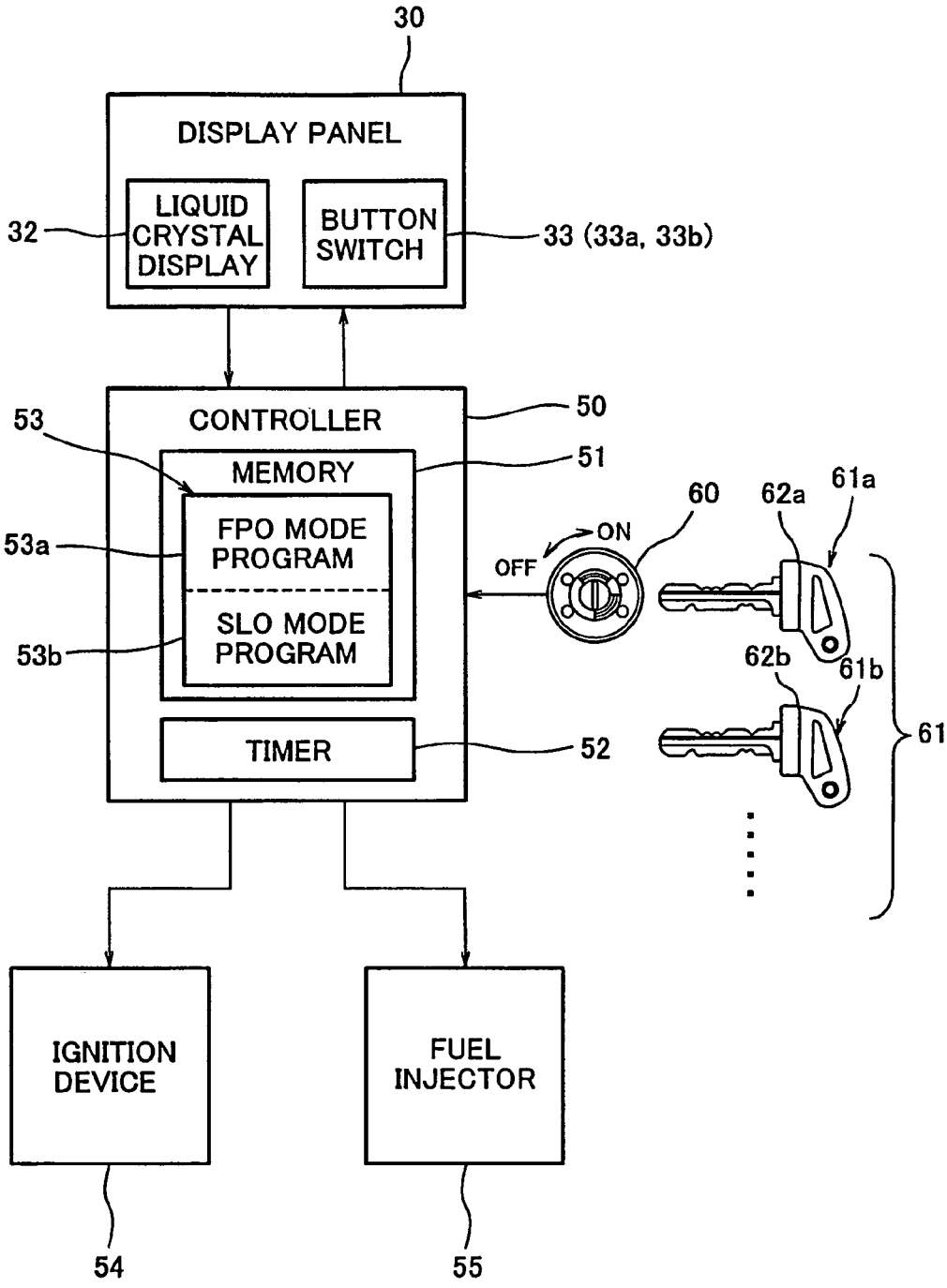
FIG. 4 is a block diagram showing a configuration in which a controller is communicatively coupled to the instrument panel equipped in the personal watercraft of FIG. 1.

As shown in FIG. 4, the display panel 32, the button switches 33*a* and 33*b* are communicatively coupled to a controller 50 equipped inside the body 1 through signal lines. The controller 50 includes a built-in memory 51 and a timer 52 implemented by software. The memory 51 contains programs 53 regarding a plurality of control modes for controlling the components equipped in the watercraft, including the engine E (FIG. 1). The timer 52 is configured to count time, and the multi-display portion 43 (see FIG. 3) of the display panel 32 is configured to display a current time, an accumulated travel time period, and other information. In addition, the timer 52 is configured to count an accumulated time period during which the set switch 33*a* and the mode switch 33*b* are continuously pressed.

The controller 50 is communicatively coupled to an ignition device 54, a fuel injector 55 and the like of the engine E through signal lines. The controller 50 is further communicatively coupled to various sensors (not shown) attached to components of the watercraft, for example, a fuel sensor attached to a fuel tank, a battery sensor attached to a battery, an oil-pressure sensor attached to the engine E, a water-temperature sensor, a throttle sensor, a boost sensor, an air-intake temperature sensor, a cam angle sensor, a crank angle sensor, and other suitable sensors. The display panel 32 is configured to display the information detected by one or more of these sensors. For example, the fuel meter 41 (see FIG. 3) equipped in the display panel 32 is configured to indicate a fuel remaining amount and the speedometer 44 (see FIG. 3) is configured to indicate the travel speed of the personal watercraft 32.

The control modes in which the controller 50 controls the personal watercraft includes, for example, a normal output control mode (hereinafter referred to as a FPO mode) in which the controller 50 controls an engine operation of the personal watercraft without setting an upper limit of an engine output, and a low output control mode (hereinafter referred to as a SLO mode) in which the controller 50 controls the engine operation under the condition in which the upper limit of the engine output is set. When the rider operates the mode switch 33*b* equipped in the instrument panel 30, the controller 50 switches the control mode based on a predetermined signal received from the mode switch 33*b*.

The controller 50 controls, based on the respective control modes, parameters such as an ignition timing of the ignition device 54 of the engine E, a fuel injection amount and a fuel injection timing of the fuel injection device 55 of the engine E. The program 53 includes an FPO mode program 53*a* containing a procedure by which the controller 50 controls the above mentioned parameters based on the FPO mode, and an SLO mode program 53*b* containing a procedure by which the controller 50 controls the parameters based on the SLO mode.

Figure 5:
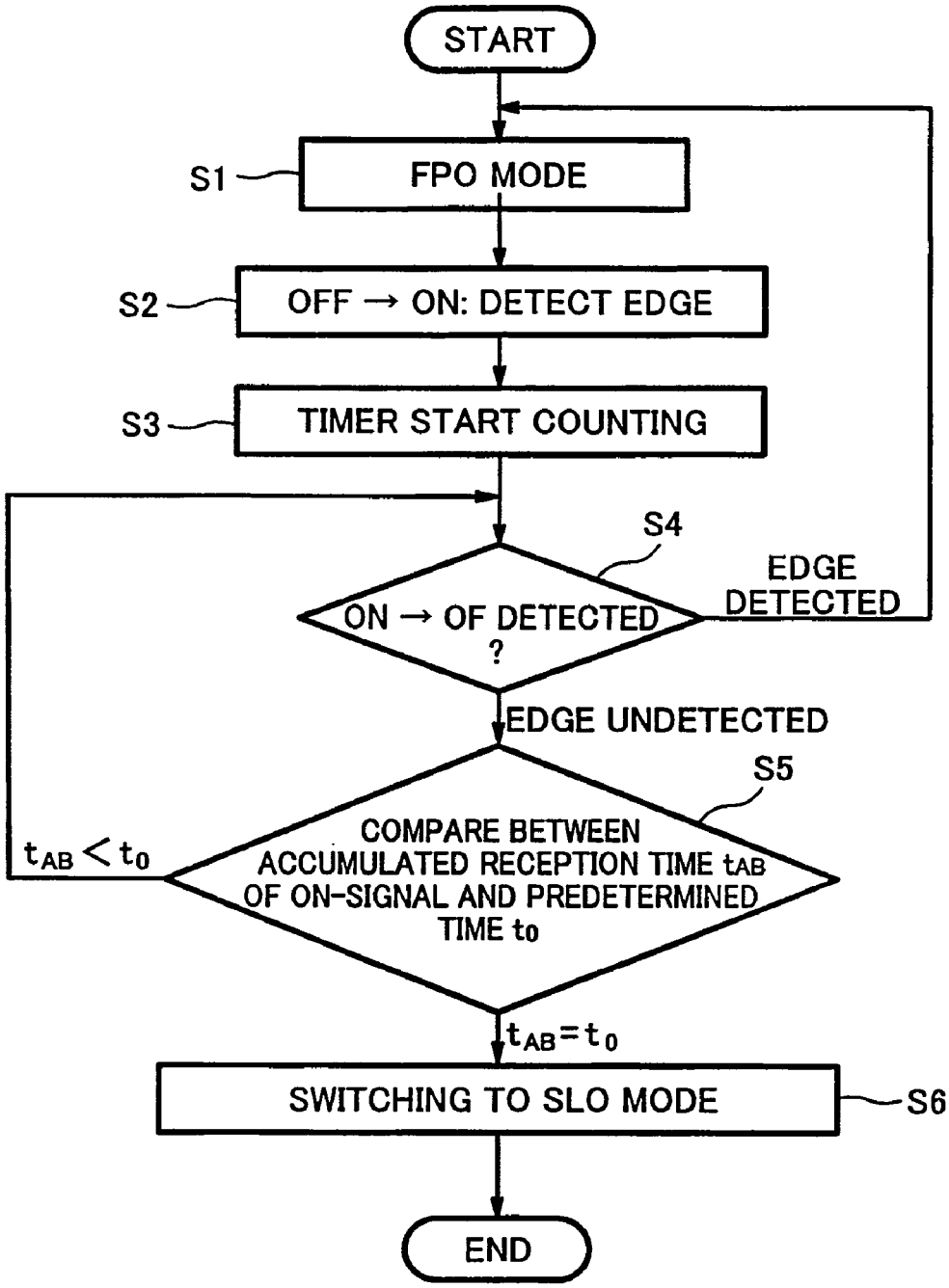
FIG. 5 is a flowchart showing an operation of the controller to switch the control mode.
Figure 6:
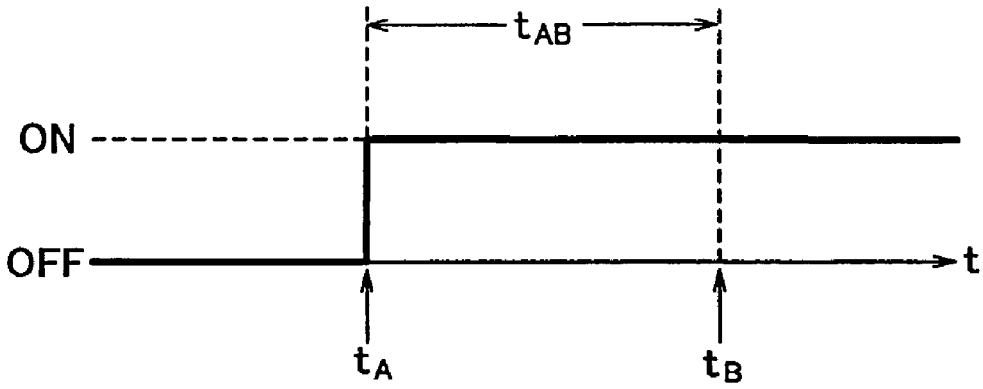
FIG. 6 is a timing chart showing a switching time of the control mode.

FIG. 5 is a flowchart showing a control mode switching operation executed by the controller 50. FIG. 6 is a timing chart showing a switch timing of the control mode based on the signal received from the mode switch 33*b*. Hereinbelow, the switching operation from the FPO mode to the SLO mode will be described with reference to FIGS. 5 and 6.

Turning to FIG. 5, upon the rider pressing the mode switch 33*b* under the condition in which the controller 50 is controlling the personal watercraft based on the FPO mode (step S1), the controller 50 detects an edge at which the signal received from the mode switch 33*b* transitions from an OFF-state to an ON-state (step S2), and the timer 52 starts counting time to measure an accumulated time period after a time (time tA in FIG. 6) at which the edge has been detected, i.e., an accumulated reception time of the ON-signal (step S3).

Then, it is determined whether or not an edge at which the signal transitions from the ON-state to the OFF-state has been detected (step S4). If it is determined that the edge remains undetected in step S4, and that the accumulated reception time period (time period tAB from time tA to time tB) of the ON-signal has reached a predetermined time period to (e.g., 7 sec) (step S5), the controller 50 switches the FPO mode to the SLO mode (step S6), and controls the watercraft based on the SLO mode.

On the other hand, if it is determined that the edge has been detected in step S4 before the accumulated reception time period tAB of the ON-signal reaches the time period to, the controller 50 continues to control the watercraft based on the current FPO mode without transitioning to the SLO mode. It shall be understood that the operation of the controller 50 in the transition from the SLO mode to the FPO mode is similar to that in the transition from the FPO mode to the SLO mode, and will not be further described.

When the control mode has been switched and the controller 50 starts to control the components of the watercraft based on a new control mode, the indicator lights 40 through 48 provided in the display panel 32 of the instrument panel 30 are turned on to light up for a predetermined time to inform the rider that the control mode has been switched. When the new mode is the SLO mode, the multi-display portion 43 displays mode information indicating that the watercraft is being controlled based on the SLO mode after all the lights 40 through 48 have been turned on, to inform the rider of the current control mode.

Figure 7:
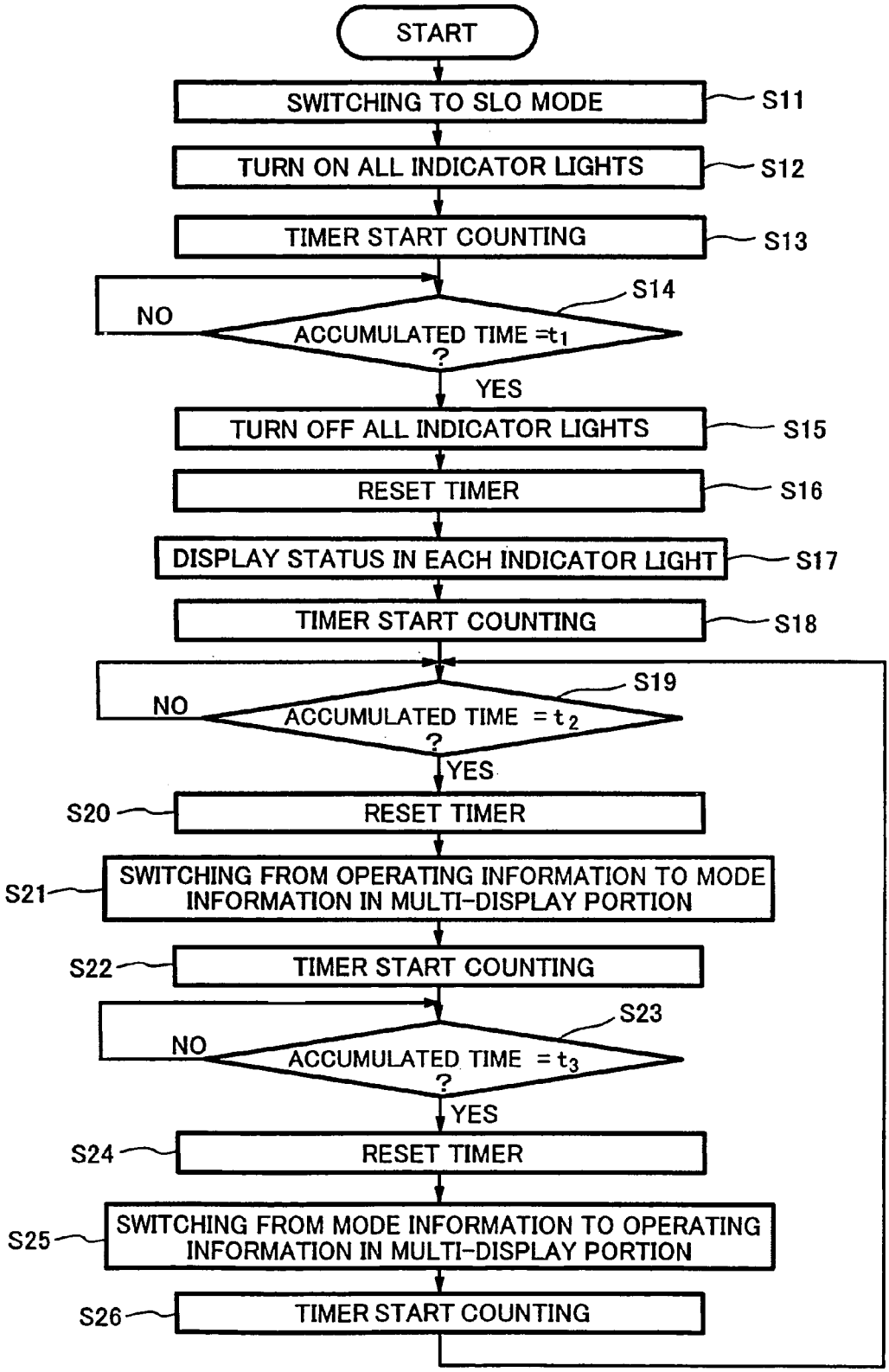
FIG. 7 is a flowchart showing an operation of the controller to control display of a display panel in the instrument panel, just after transitioning from a FPO mode to a SLO mode.
Figure 8:
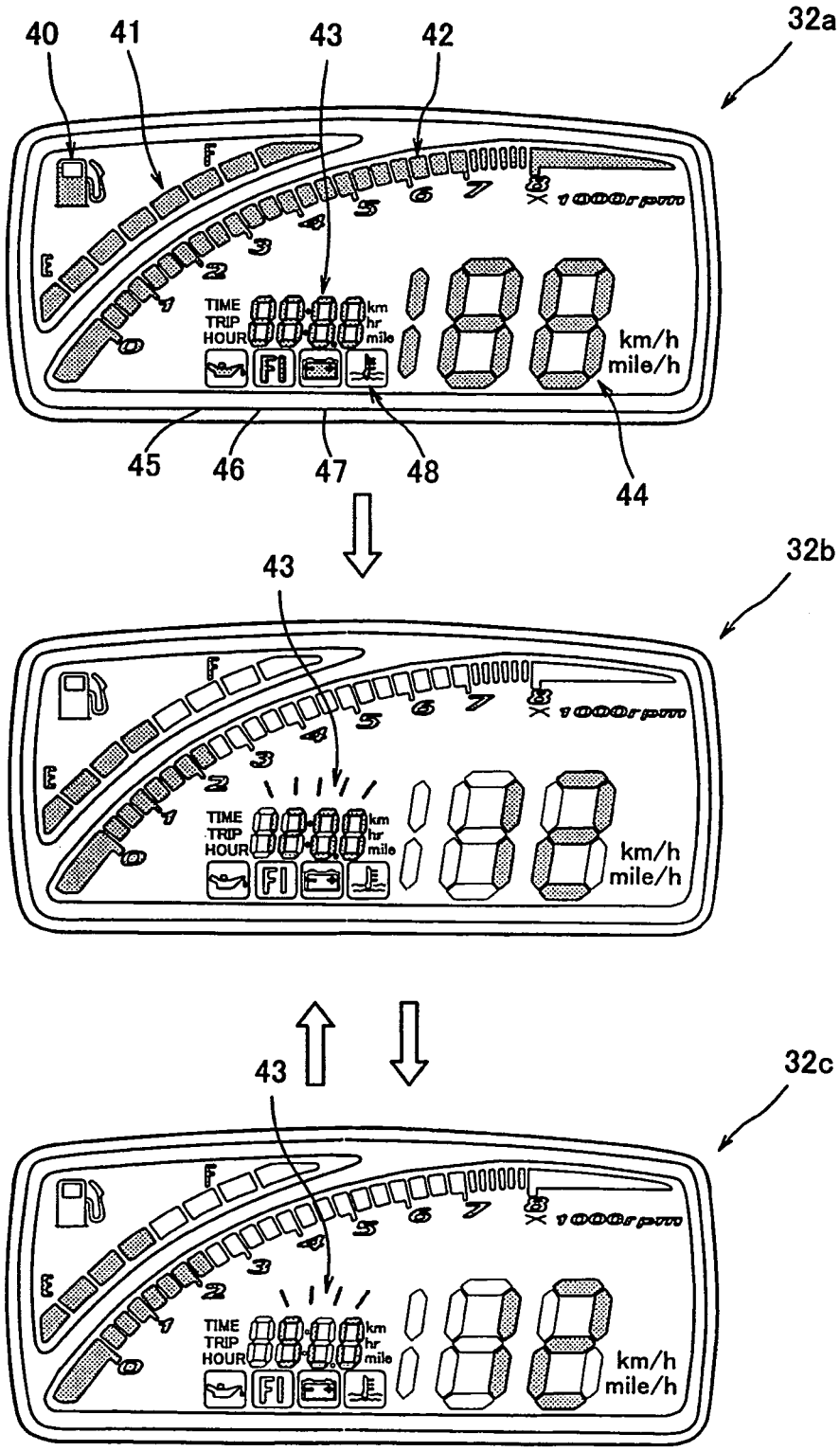
FIG. 8 is a view showing light-up conditions of the display panel, just after transitioning from the FPO mode to the SLO mode.

FIG. 7 is a flowchart showing a control operation executed by the controller 50 to control display of the display panel 32, just after transitioning from the FPO mode to the SLO mode. FIG. 8 is a view showing light-up conditions of the display panel 32 at this time. Turning to FIG. 7, if it is determined that the control mode has transitioned from the FPO mode to the SLO mode (step S11), the controller 50 causes all the indicator lights 40 through 48 provided in the display panel 32 to be turned on (step S12) as indicated by a display panel 32*a* in FIG. 8. Simultaneously, the controller 50 causes the timer 52 to start counting time (step S13). If it is determined that the counted accumulated time period has reached a predetermined time period t1 (e.g., 2 seconds) (step S14), the controller 50 causes the indicator lights 40 through 48 to be turned off (step S15) and causes the timer 52 to be reset (step S16).

Then, the controller 50 causes the indicator lights 40 through 48 to indicate information regarding various states of the watercraft as in a condition before transitioning to the SLO mode (step S17) as indicated by a display panel 32*b* in FIG. 8 and cause the timer 52 to re-start counting time (step S18). At this time, the multi-display portion 43 displays the operating information regarding the operating state of the watercraft, for example, "12:00" indicating that an accumulated travel time period is 12 hours.

If it is determined that the counted accumulated time period has reached a predetermined time period t2 (e.g., 3 sec) (step S19), after the timer 52 starts counting time (Step S18), the controller 50 causes the timer 52 to be reset (step S20) and causes the multi-display portion 43 to display the mode information indicating the SLO mode instead of the operating information (step S21). Simultaneously, the controller 50 causes the timer 52 to start counting time (step S22). In this embodiment, "SLO" is displayed as the mode information on the multi-display portion 43 in step S21 to enable the rider to easily check the information (see display panel 32*c* in FIG. 8).

If it is determined that the counted accumulated time has reached a predetermined time period t3 (e.g., 1 sec)(step S23) after the timer 52 started counting time in step S22, the controller 50 causes the timer 52 to be reset (step S24) and causes the multi-display portion 43 to display the operating information instead of the mode information (step S25) as indicated by the display panel 32*b* in FIG. 8. Simultaneously, the controller 52 causes the timer 52 to start counting time (Step S26). Thereafter, the steps 19 through 26 are repeated, and the multi-display portion 43 alternately displays the operating information as illustrated by the display panel 32*b* in FIG. 8 or the mode information as illustrated by the display panel 32*c* in FIG. 8, for the predetermined time period t2 or t3, respectively.

Since the time period t2 during which the operating information is displayed is set longer than the time period t3 during which the mode information is displayed, the rider can recognize the control mode being executed and the operating information displayed on the multi-display portion 43 while traveling . . . In addition, all the indicator lights 40 through 48 are turned on for the predetermined time period t1 just after the control mode has been switched to enable the rider to easily notice that the control mode has been switched. During the predetermined time period t1, the indicator lights 40 through 48 may alternatively blink in relatively short cycles. In this case, the rider can more easily notice that the control mode has been switched. In a further alternative, a part or subset of the indicator lights 40 through 48 may be turned on so long as the rider can notice that the control mode has been switched.

When the mode switch 33*b* is pressed in the middle of the steps 19 through 26 repeated in the SLO mode, and the accumulated reception time period tAB of the ON-signal has reached the predetermined time period to, the controller 50 switches the SLO mode to the FPO mode at that point of time. In that case, the controller 50 switches from the SLO mode to the FPO mode as in the operation to switch from the FPO mode to the SLO mode (see steps S5 and S6 in FIG. 5).

Figure 9:
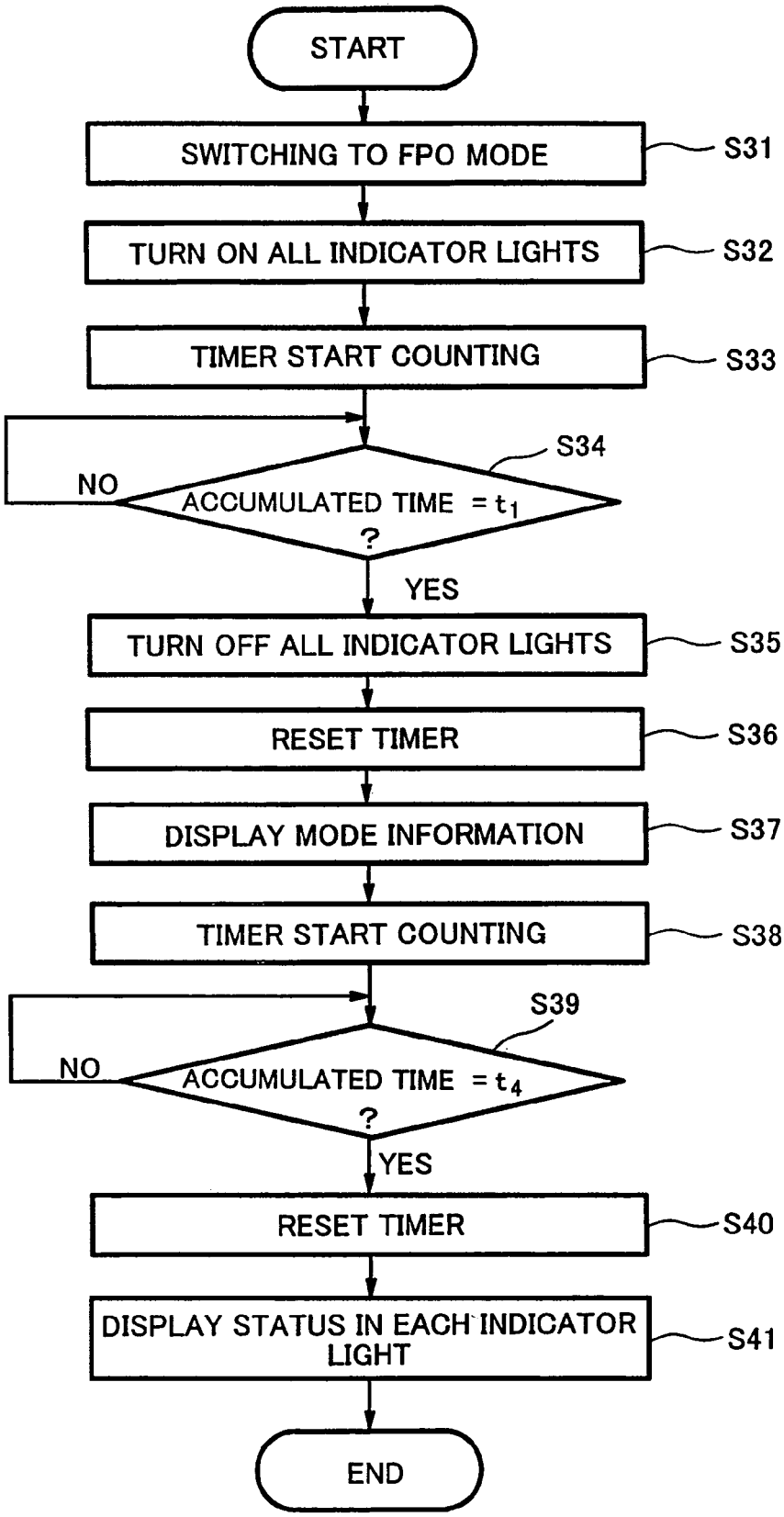
FIG. 9 is a flowchart showing an operation of the controller to control display of the display panel, just after transitioning from the SLO mode to the FPO mode.

A control operation executed by the controller 50 to control display of the display panel 32 just after transitioning from the SLO mode to the FPO mode will be described with reference to the flowchart of FIG. 9 and the light-up conditions of the display panel 32 in FIG. 10. As shown in FIG. 9, when the control mode has transitioned from the SLO mode to the FPO mode (step S31), the operation similar to steps 12 through 16 described with reference to FIG. 7 are sequentially carried out (steps S32 to S36). A display panel 32*d* in FIG. 10 illustrates that all the indicator lights 40 through 48 are turned on in step 32 of FIG. 9, similar to the display panel 32*a* in FIG. 8.

When all the indicator lights 40 through 48 have been turned off (step S35) and the timer 52 has been reset (step S36), the controller 50 causes the multi-display portion 43 to display the mode information (step S37), and causes the timer 52 to start counting time (step S38). In this embodiment, "FPO" is displayed as the mode information on the multi-display portion 43 to enable the rider to easily recognize the FPO mode being executed (see display panel 32*e* in FIG. 10).

If it is determined that the counted accumulated time has reached a predetermined time period t4 (e.g., 2 seconds)(step S39) after the timer 52 started counting time in step. S38, the controller 50 causes the timer 52 to be reset (S40) and causes the indicator lights 40 through 48 to continuously display the information indicating the statuses of the watercraft (step S41) as indicated by a display panel 32*f* in FIG. 10. After the step S41, the operating information is continuously displayed on the multi-display portion 43.

Figure 10:
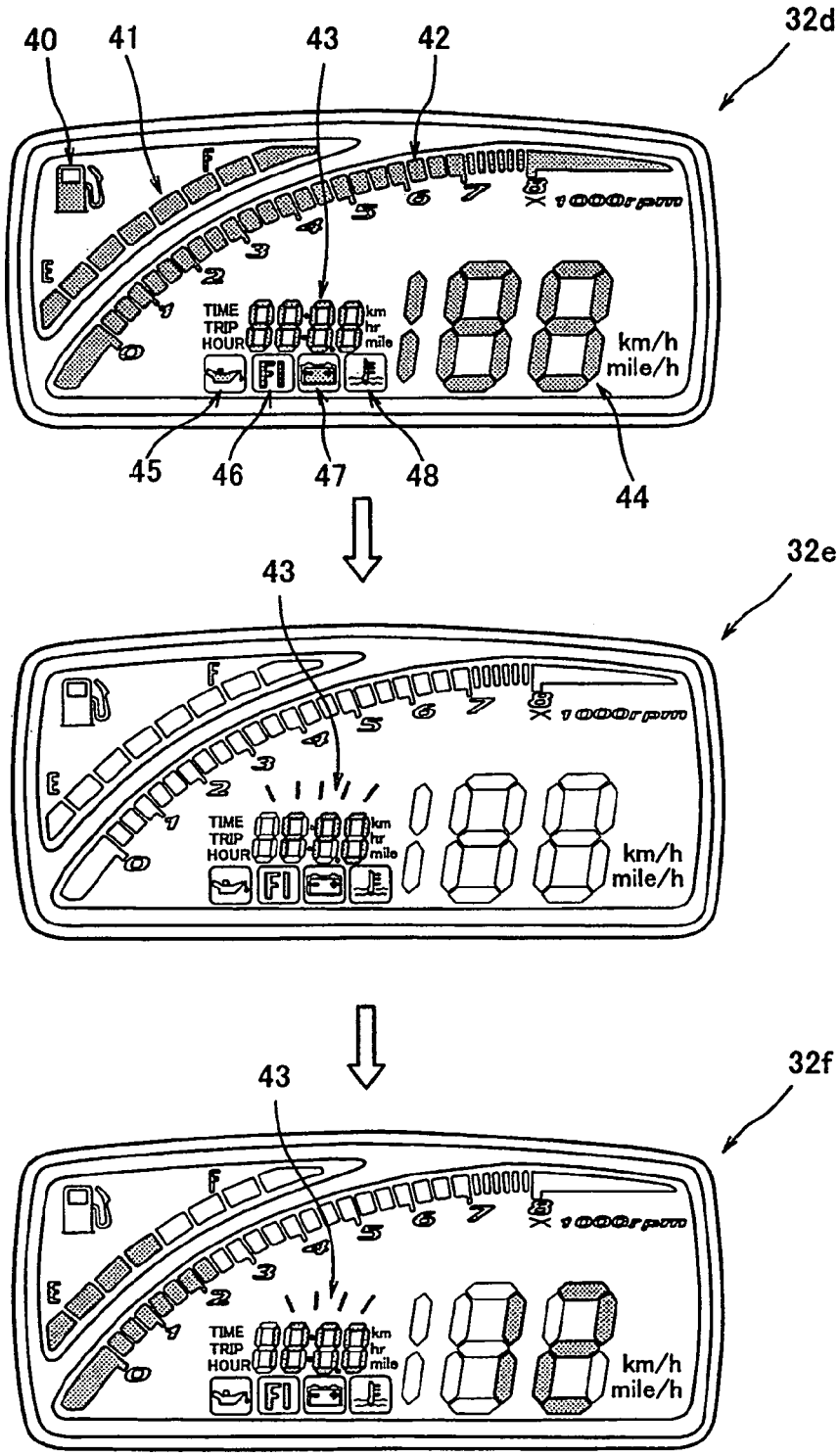
FIG. 10 is a view showing light-up conditions of the display panel, just after transitioning from the SLO mode to the FPO mode.

During the operation illustrated in FIG. 9, the timer 52 is reset in step S36 and then the mode information is displayed on the multi-display portion 43 of the display panel 32 (step 37) as indicated by a display panel 32*e* in FIG. 10, the information indicating the statuses of the personal watercraft may be displayed on the indicator lights 40 to 42 and 44 to 48 at this time. In this case, in step 41, only switching from display of the mode information to display of the operating information is performed on the multi-display portion 43. When the mode switch 33*b* is pressed after the step S41 in the FPO mode, the controller 50 operates according to the procedure in FIG. 5 to continue the FPO mode or switch to the SLO mode (see step S5 of FIG. 5).

As described above, the control mode is switched by pressing the mode switch 33*b* for the predetermined time period t0. Alternatively, as shown in FIG. 4, in the personal watercraft equipped with a key type main switch 60, the control mode may be determined according to a key 61 inserted into the main switch 60.

Specifically, a plurality of keys 61 (such as key 61*a* and key 61*b*) capable of operating the main switch 60 are prepared. The keys 61 contain transponders (not shown) in handle portions 62*a*, 62*b*. Unique identification information for identifying the respective keys 61 is stored in the transponders. When any of the keys 61 is inserted into the main switch 60, the identification information stored in the corresponding transponder is transmitted to the controller 50 by wire or radio.

The controller 50 contains, in the built-in memory 51, the programs 53*a* and 53*b* of the control modes corresponding to the respective identification information and information (not shown) for associating the respective identification information with the respective programs 53*a* and 53*b* of the control modes. When the controller 50 receives the unique identification information associated with the key 61, it controls the components of the watercraft based on the control mode corresponding to the identification information.

The above described construction is effective when one personal watercraft is shared among several persons and each person owns a key 61 and has a demand to control the watercraft based on the control mode selected by the key 61. In that case, the switching operation of the control mode illustrated in FIGS. 5 and 6 is unnecessary. When the controller 50 detects the identification information stored in the key 61 inserted into the main switch 60, it executes the operation (operation in the SLO mode) after the step S12 in FIG. 7 or the operation (operation in the FPO mode) after the step 32 in FIG. 9 so as to correspond to the identification information and causes the control mode being executed to be presented to the rider.

As described above, the controller 50 executes switching between the operating information and the mode information in the SLO mode based on the time periods t2 and t3, but this is merely exemplary. Alternatively, the controller 50 may be configured to execute switching between the operating information and the mode information based on a travel distance. More specifically, the controller 50 may be configured to switch from the operating information to the mode information when detecting that the watercraft has traveled a predetermined distance (X1 meters), and to thereafter switch from the mode information to the operating information when detecting that the watercraft has traveled a predetermined distance (X2 meters). In a further alternative, the controller 50 may be configured to execute switching based on an engine speed of the engine. E. More specifically, the controller 50 may be configured to switch from the operating information to the mode information when detecting that the engine is running at a predetermined engine speed (Y1), and to thereafter switch from the mode information to the operating information when detecting that the engine is running at a predetermined engine speed (Y2). In a further alternative, the controller 50 may be configured to execute switching based on the number of pulses output from a sensor, for example, a crank angle sensor, which is configured to output a pulse signal according to the engine speed of the engine E. More specifically, the controller 50 may be configured to switch from the operating information to the mode information when detecting that the number of pulses output from the sensor has reached a predetermined number (Z1), and to thereafter switch from the mode information to the operating information when detecting that the number of pulses has reached a predetermined number (Z2).

As described above, during the SLO mode after switching from the FPO mode, the switching between the mode information and the operating information is performed during substantially that entire SLO mode period, and this is merely exemplary. For example, the engine speed of the engine E typically increases and decreases according to an increase and a decrease in a rotational angle of a grip 24*a* (see FIG. 1) provided at an end portion of the handle 24. In the personal watercraft of this embodiment, since the engine speed of the engine E may be limited to a predetermined speed or lower in the SLO mode, the engine speed of the engine E is set not to increase even when the grip 24*a* is rotated a predetermined angle or more. In the personal watercraft thus configured, the operating information is displayed until the engine speed meets an upper limit value, while when the grip 24*a* is being rotated the predetermined angle or more with the engine speed meeting the upper limit value, the switching between the operating information and the mode information may be carried out.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A display device of a personal watercraft comprising:

a memory configured to store a plurality of control modes for controlling components of the watercraft;

a controller configured to control the components of the watercraft based on a control mode selected from the plurality of control modes; and a display portion that is provided in a display panel positioned in the vicinity of a steering handle of the watercraft and is configured to display operating information of the watercraft based on a signal received from the controller while the watercraft is traveling;

wherein the display portion is configured to selectively display different respective mode information associated with each of the plurality of control modes in character form;

wherein, the controller is configured to cause the display portion to display the respective mode information associated with the selected control mode, which indicates the watercraft is controlled based on the selected control mode, instead of displaying the operating information, when the controller controls the watercraft based on the selected control mode.

2. The display device of a personal watercraft according to claim 1, wherein the display portion is configured to alternately display the operating information and the mode information, each for a predetermined time period when the controller controls the components of the watercraft based on the selected control mode.

3. The display device of a personal watercraft according to claim 2, wherein a time period during which the mode information is displayed before switching to the operating information is set shorter than a time period during which the operating information is displayed before switching to the mode information.

4. The display device of a personal watercraft according to claim 2, wherein the plurality of control modes include a normal output control mode in which the controller controls an engine operation without setting an upper limit of an engine output, and a low output control mode in which the controller controls the engine operation under a condition in which the upper limit of the engine output is set; and wherein the display portion displays the mode information associated with the low output control mode instead of the operating information when the controller controls the engine operation based on the low output control mode.

5. The display device according to claim 1, wherein the display panel includes an indicator light configured to light up or blink based on the signal received from the controller, and the indicator light lights up for a predetermined time period or blinks for a predetermined time period before the display portion displays the mode information associated with the selected control mode, when the controller starts control based on the selected control mode.

* * * * *